US011159865B1

(12) United States Patent
Johnson

(10) Patent No.: US 11,159,865 B1
(45) Date of Patent: Oct. 26, 2021

(54) MEDIA-SOURCE-INTEGRATED SPEAKER AND SYSTEM FOR CUSTOM STEREO INSTALLATION

(71) Applicant: Joshua David Johnson, Kalispell, MT (US)

(72) Inventor: Joshua David Johnson, Kalispell, MT (US)

( * ) Notice: Subject to any disclaimer, the term of this patent is extended or adjusted under 35 U.S.C. 154(b) by 0 days.

(21) Appl. No.: 17/008,614

(22) Filed: Aug. 31, 2020

Related U.S. Application Data

(60) Provisional application No. 62/894,678, filed on Aug. 30, 2019.

(51) Int. Cl.
*H04R 1/02* (2006.01)

(52) U.S. Cl.
CPC ..... *H04R 1/025* (2013.01); *H04R 1/026* (2013.01); *H04R 2201/021* (2013.01); *H04R 2420/07* (2013.01)

(58) Field of Classification Search
CPC .. H04R 1/025; H04R 1/026; H04R 2201/021; H04R 2420/07
See application file for complete search history.

(56) References Cited

U.S. PATENT DOCUMENTS

2004/0264708 A1* 12/2004 Dupeire ..... H04R 5/04 381/79
2008/0008338 A1* 1/2008 Yoon ..... H04R 5/02 381/303
2009/0110216 A1* 4/2009 Tschirpke ..... H04R 1/025 381/120

* cited by examiner

*Primary Examiner* — Andrew L Sniezek
(74) *Attorney, Agent, or Firm* — Law Office of Craig Bohn; Craig E. Bohn

(57) ABSTRACT

A media-source-integrated speaker-based sound system comprising a media-source-integrated circuit board connectable to an in-wall speaker within an in-wall speaker securement site, and lightweight wiring connectable intermediate to a low-voltage power source and the media-source-integrated circuit board, and including a process for converting a conventional in-wall, wired stereo system to a media-source-integrated speaker-based sound system.

2 Claims, 7 Drawing Sheets

--Prior Art--

--Prior Art--

--Prior Art--

--Prior Art--

--Prior Art--

--Prior Art--

--Prior Art--

MEDIA-SOURCE-INTEGRATED SPEAKER AND SYSTEM FOR CUSTOM STEREO INSTALLATION

CROSS-REFERENCE TO RELATED APPLICATIONS

This application claims the benefit of U.S. Application No. 62/894,678, filed on Aug. 30, 2019, by the present inventor, entitled "Media-Source-Integrated Speaker and System for Custom Stereo Installation," which is hereby incorporated by reference in its entirety for all allowable purposes, including the incorporation and preservation of any and all rights to patentable subject matter of the inventor, such as features, elements, processes and process steps, and improvements that may supplement or relate to the subject matter described herein.

STATEMENT REGARDING FEDERALLY SPONSORED RESEARCH OR DEVELOPMENT

Not Applicable

BACKGROUND OF THE INVENTION

This invention relates generally to sound system installation equipment, and more specifically to speaker systems installed into the wall or ceiling of a room. Currently, installed speaker systems include hard-wired systems that may be installed within the ceiling and walls of a room and directly connected to an electronic stereo system by wiring that is ran through the walls. The wire must be of adequate size (gauge) to support adequate analog signal to carry the media from the stereo system to the various speakers without loss of fidelity. Wireless speakers are available that can independently receive media through various means, including radio waves, and digital WiFi and Bluetooth® technologies, but the require independent power sources, and are not designed to become a permanent fixture of the house. Such wireless speakers are traditionally intended to be removed and/or relocated by the user.

SUMMARY OF THE INVENTION

It would be an improvement to the field of art to provide a media-source-integrated speaker, and a media-source-integrated speaker-based sound system, collectively powerable by low-voltage wiring, installable within typical in-wall speaker enclosures. The system may rely on wireless communication and synchronization of the media across the numerous speakers, so that wiring to the remote installation locations need only support enough power to operate the media-source-integrated speaker. Low-voltage wiring may be accomplished with more easily and with less cost with lightweight and less expensive wire (herein referred to as "low-voltage wire"), such as speaker wire, ethernet wire (e.g. CAT 5), doorbell wire, and security wire, to name a few.

This disclosure uses the United States National Electric Code (NEC) standards for simple voltage ranges, which set "low voltage" (LV) as commonly under 100V, a voltage range that carries a low risk of injury, for example, if a person were to touch a wire carrying a low voltage current with dry hands it is unlikely they would be electrocuted, and "high voltage" (HV) as anything above 100V that can potentially cause human harm. The NEC also designates that voltages below 50 volts may be considered "extra-low voltage" (ELV). In this disclosure uses of the term "low-voltage" will include voltages in the range of LV and ELV, unless specifically limited. Typical low-voltage system in the United States run at either 12 volts or 24 volts, but low-voltage equipment and systems currently exist that run at just under the 50-volts threshold for ELV.

Adapting a system to use low-voltage wire may permit replacement of more costly and dangerous wiring, wiring that is more difficult to run through existing walls, and wiring that may require more costly shielding, connectors, and junction boxes. Additionally, providing the required lower levels of power avoids dangers inherent in standard line voltage wiring, such as electrocution and the risks of fire. Additionally, such a low-voltage system may be easily adapted to environments where line voltage is either 110-volt or 220-volt, since a single appropriate transformer may provide the lower power used for the system, while the other components may remain the same, regardless of the source current.

DESCRIPTION OF THE PREFERRED EMBODIMENT

Figure 1:
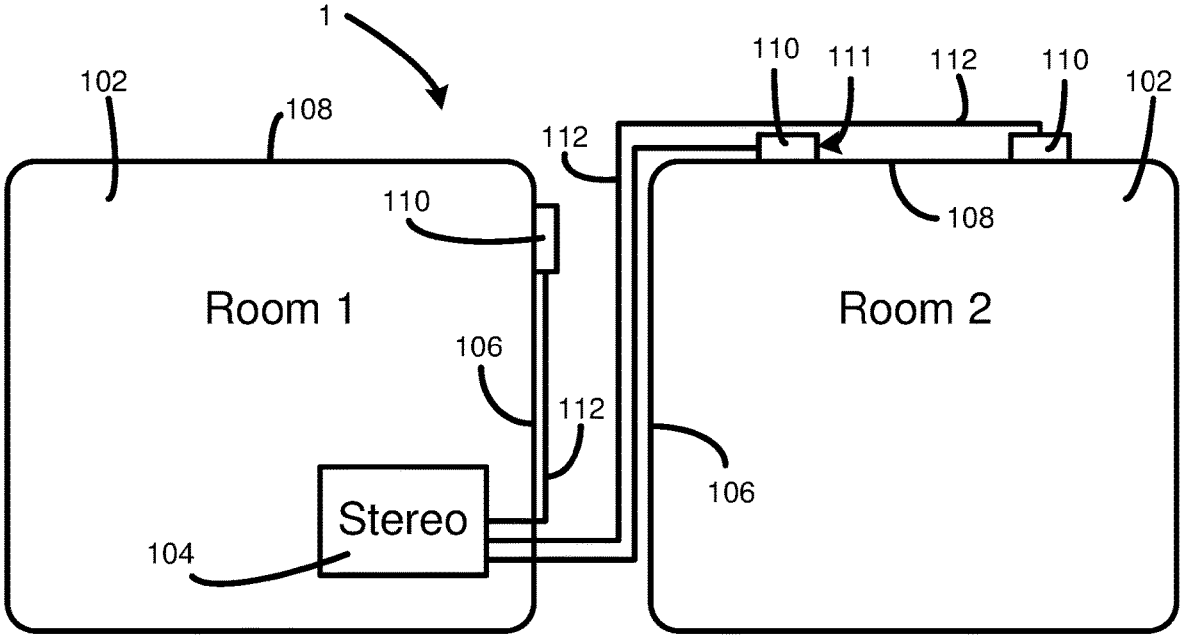
FIG. 1 is a schematic depiction of a Prior Art in-wall, wired stereo system.
Figure 3A:
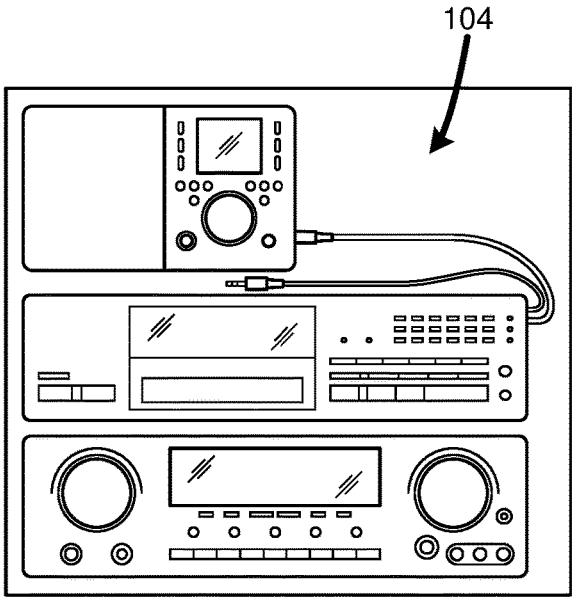
FIG. 3*a* is an illustration of the front of an exemplary typical Prior Art stereo equipment set for generating electronic media for transmission over installed speaker wire.
Figure 3B:
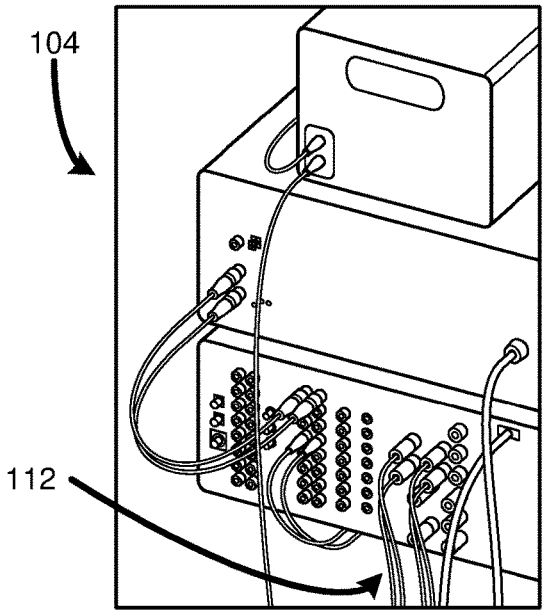
FIG. 3*b* is an illustration of the rear of an exemplary typical Prior Art stereo equipment set for generating electronic media for transmission over installed speaker wire.
Figure 3C:
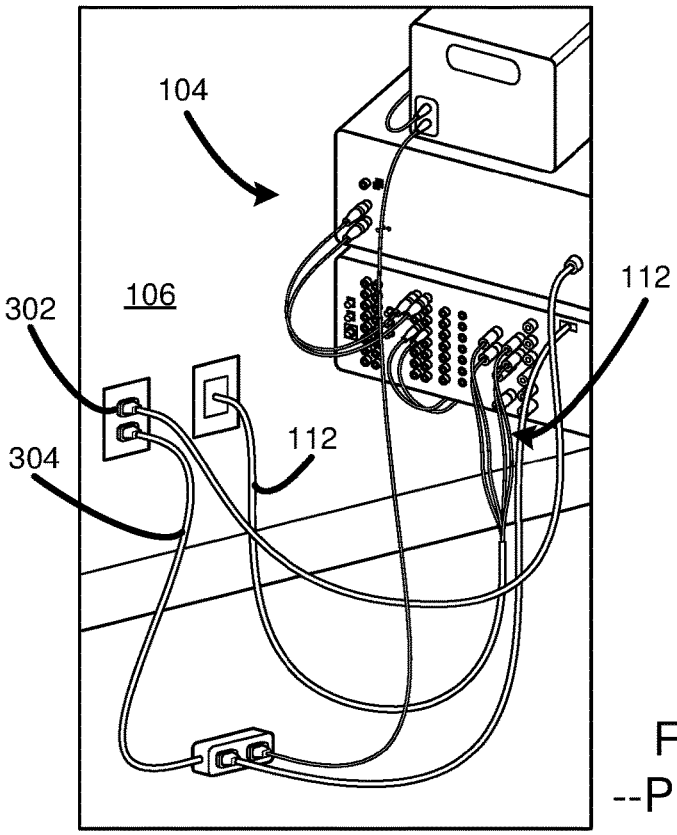
FIG. 3*c* is an illustration of the rear of an exemplary typical Prior Art stereo equipment set for generating electronic media for transmission over installed speaker wire, including a power source and depiction of the speaker wire entering the wall.
Figure 4A:
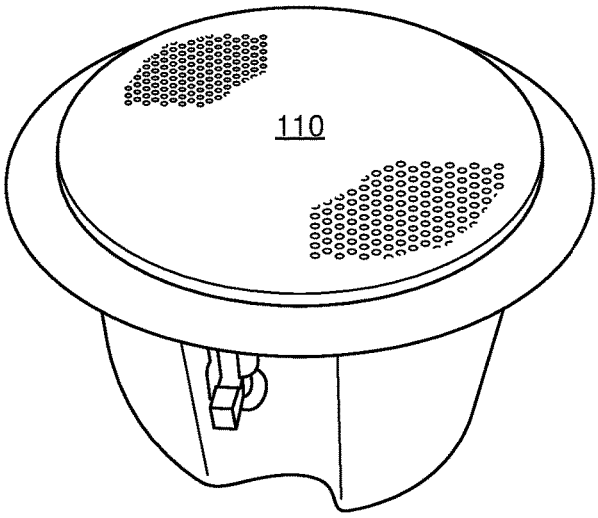
FIG. 4*a* is an illustration of the front of an exemplary Prior Art speaker suitable for in-wall installation.
Figure 4B:
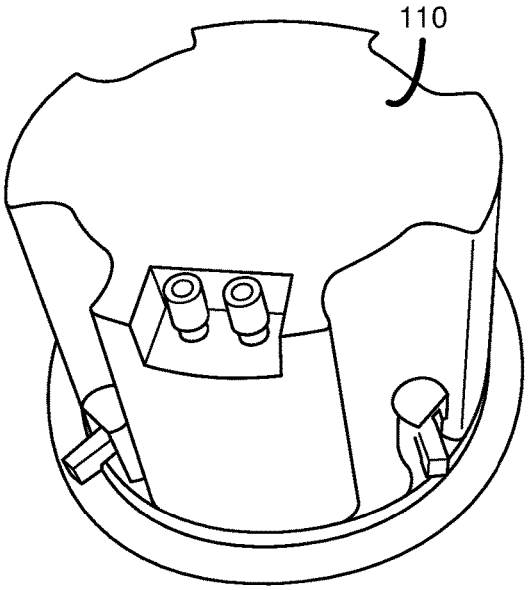
FIG. 4*b* is an illustration of the rear of the speaker in FIG. 4*a*.
Figure 4C:
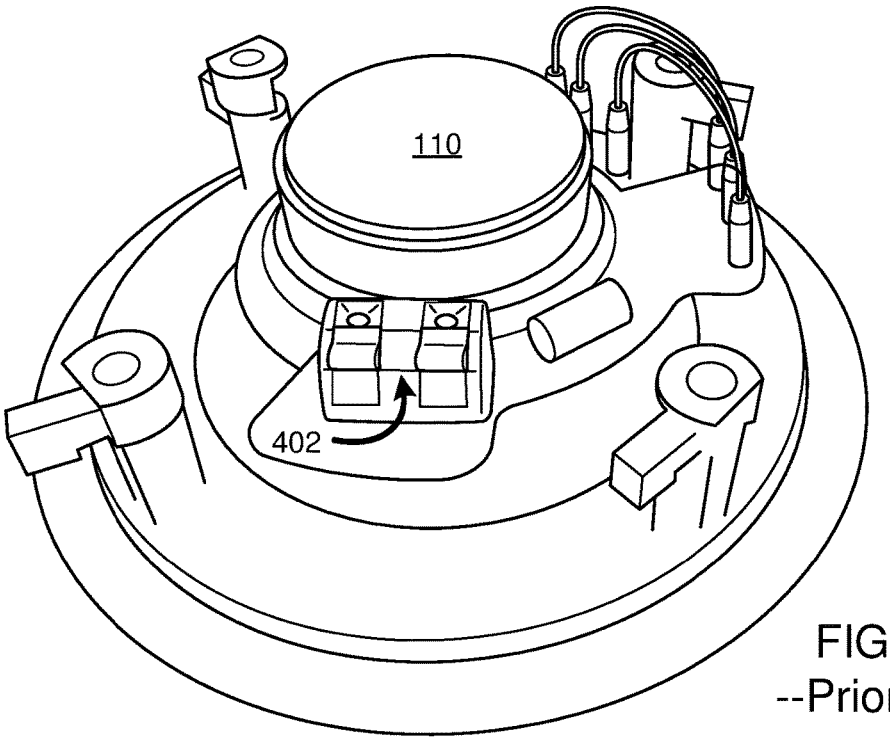
FIG. 4*c* is an illustration of the exposed interior components of the speaker in FIG. 4*a*.

A prior art stereo system 1 is depicted in FIG. 1, where a component stereo system, or "stereo," 104, such as the example shown in FIGS. 3*a*, 3*b*, and 3*c*, may be located in a room 102. The stereo 104 is powered by an AC current, typically 110 v, from an AC power outlet 302, through an AC power cord 304. The term stereo may refer to an amplifier, to provide power to amplify an audio signal for transmission over speaker wire 112. The term stereo may also include a music source, such as a tuner for receiving music transmitted over radio waves, a turn-table for decoding music from a record, or other various forms of music retrieval systems used to play music stored in such forms as tape, cassettes, CD's, DVD, MP3, and digital streaming, to name a few. The stereo 104 may then be connected to speakers 110, such as the example shown in FIGS. 4*a*, 4*b*, and 4*c*, which may be installed into either or both the walls 106 and ceilings 108. The speaker 110 may be housed within a speaker recess 111 in the walls 106 and ceilings 108. The stereo 104 is connected to the speakers 110 by speaker wire 112. The speaker wire 112 may be hidden from view within a room 102 by being ran through the space between the walls 106 and ceilings 108. In this disclosure, the term "room wall surface" may be used to refer to either or both walls 106 and ceilings 108. The stereo 104 creates sound in conjunction with the speakers 110 by generating a modulated electrical wave signal, referred to herein as a "media signal," and transmitting the media signal through the speaker wire 112 to the speakers 110. The speaker wire 112 may be connected to the media signal inputs 402 on a speaker 110. The speakers 110 are designed to recreate the sounds in response to the media signal.

Figure 2:
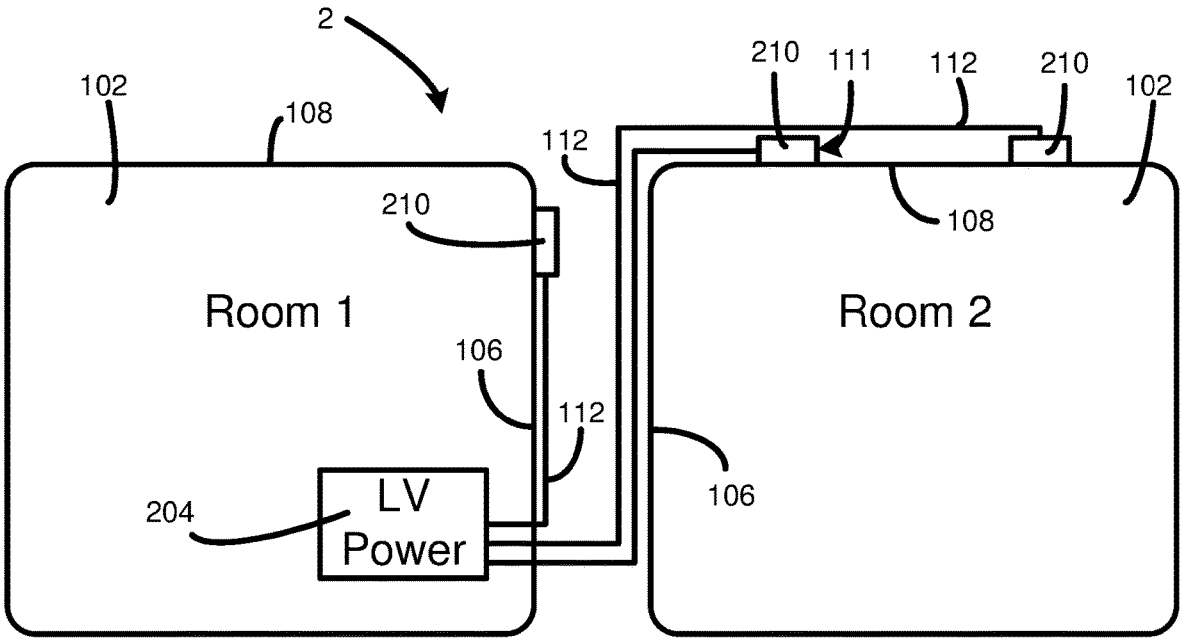
FIG. 2 is a schematic depiction of an exemplary media-source-integrated speaker-based sound system converted from the stereo system of FIG. 1, according to the present disclosure.

Referring now to FIG. 2, the stereo system 1 of FIG. 1 may be converted into an exemplary MSI speaker-based sound system 2. The stereo 104 may be removed and replaced with a low-voltage power supply 204. Additionally, the conventional speakers 110 may be removed and replaced with MSI speakers 210.

Suitable media-source-integrated speaker units may include the UE BOOM 2™ wireless speaker made by a division of Logitech International S.A., a variety of Bose Corporation SoundLink™ and SoundTouch™ wireless speakers, and a variety of Sonos, Inc., wireless speakers, such as the Play:1™ and Play:3™ speakers, just to name a few. In this disclosure the term "MSI speaker" may be used to refer to a media-source-integrated speaker unit. These MSI speakers may include components such as an output speaker, amplifier, music source interface, control interface, either or both a wireless and a wired communications module, and an MSI speaker circuit board. Additionally, in this disclosure the term "MSI speaker circuit board" may be used to refer to a component incorporating electronic components that may include amplifier, music source interface, control interface, wireless communications module, memory, and a computerized control processor.

It is also appreciated that audio signals may be transmitted to an MSI speaker by a wireless transmission technology. Wireless transmission technologies may include transfer methods such as radio waves, NFC, Android Beam, digital WiFi, and Bluetooth® technologies. It is also appreciated that audio signals may be transmitted to an MSI speaker by a wired digital connection, such by Ethernet.

The MSI speaker-based sound system permits the MSI speakers to be used to give the appearance of a more costly in-wall, wired speaker system, with advantages of eliminating harmonic distortion or analogue signal loss from impedance in the wiring. Prior art systems have used more costly, higher-gauge and quality of speaker wire to reduce wire impedance, and thereby reduce signal loss. The uses of MSI wireless speakers reduces signal loss by locating an amplifier and signal generation components close to the speaker. Additionally, a conventional system may be easily converted to an MSI speaker-based sound system by converting the function of the existing installed speaker wire from carrying the electronic media signal, to carrying the minimal power required to run the MSI speakers.

Figure 5:
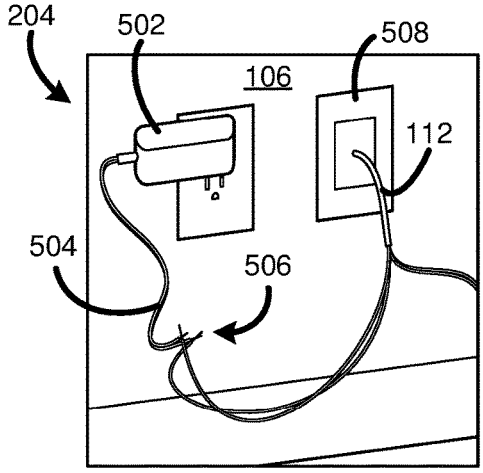
FIG. 5 is an illustration of an exemplary power transformer connected to pre-installed speaker wire.
Figure 6:
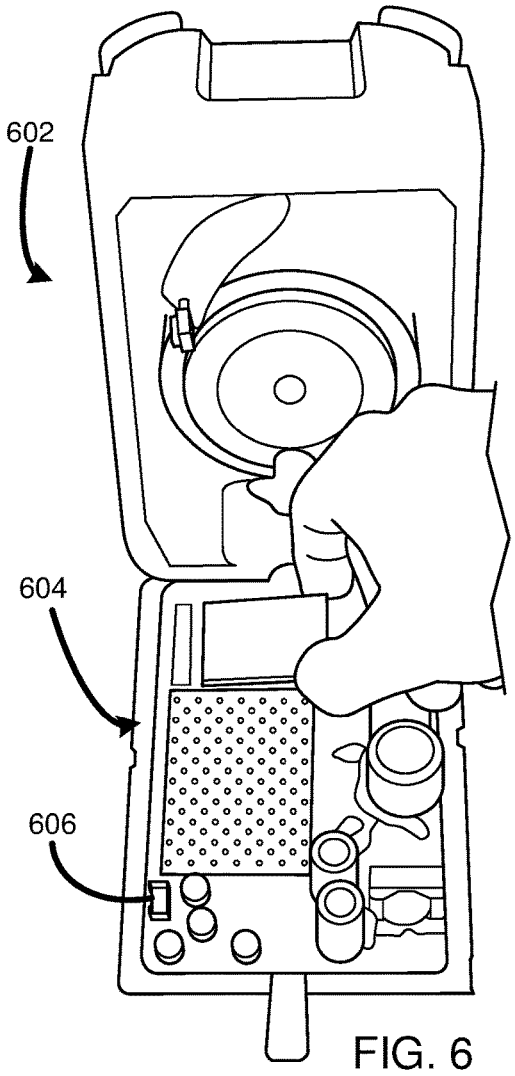
FIG. 6 is an illustration of the exposed interior of a Sonos™ media-source-integrated speaker.

Referring now primarily to FIG. 5, an exemplary low-voltage power supply 204 is shown. A transformer 502 may be used to provide appropriate power to a low-voltage power cord 504. The low-voltage power cord 504 may then be connected to the speaker wire 112 by a low-voltage connection 506, to create a low-voltage power supply 204. The new power cord (504, 112), formed from the low-voltage power cord 504 being operationally connected to the speaker wire 112, may then be routed into a wall 106 through a suitable access panel 508. The combined new low-voltage power cord (504, 112) may be referred herein as low-voltage wire, and may mean either or both the low-voltage power cord 504 and speaker wire 112, since it once functioned as speaker wire 112, is still comprised of wire referred to as "speaker wire" in the field of art, and because, once combined is the wire that carries the low-voltage power. As shown in FIGS. 1 and 2, the speaker wire 112 remains routed to the individual speaker 110 locations through the spaces between the walls 106 and ceilings 108. However, the speaker wire 112 may now be a low-voltage power supply 204. As a low-voltage power supply 204, the speaker wire 112 will no longer deliver media signal, so it must be disconnected from the speaker inputs 402 of each speaker 110.

Figure 7A:
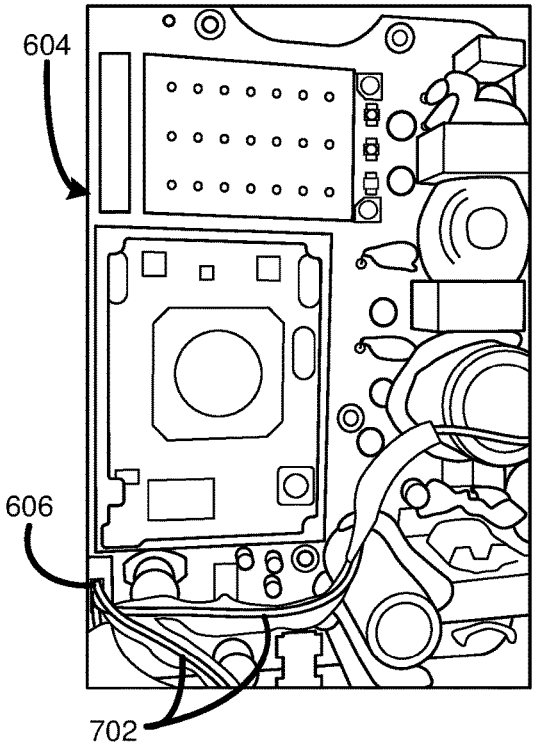
FIG. 7*a* is an illustration of the speaker-output side of an exemplary media-source-integrated speaker circuit board.
Figure 7B:
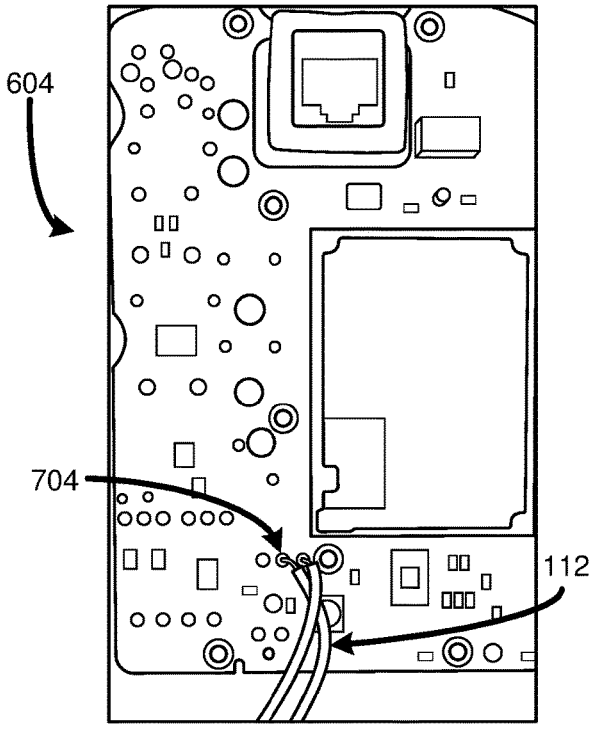
FIG. 7*b* is an illustration of the power-input side of an exemplary media-source-integrated speaker circuit board.
Figure 8A:
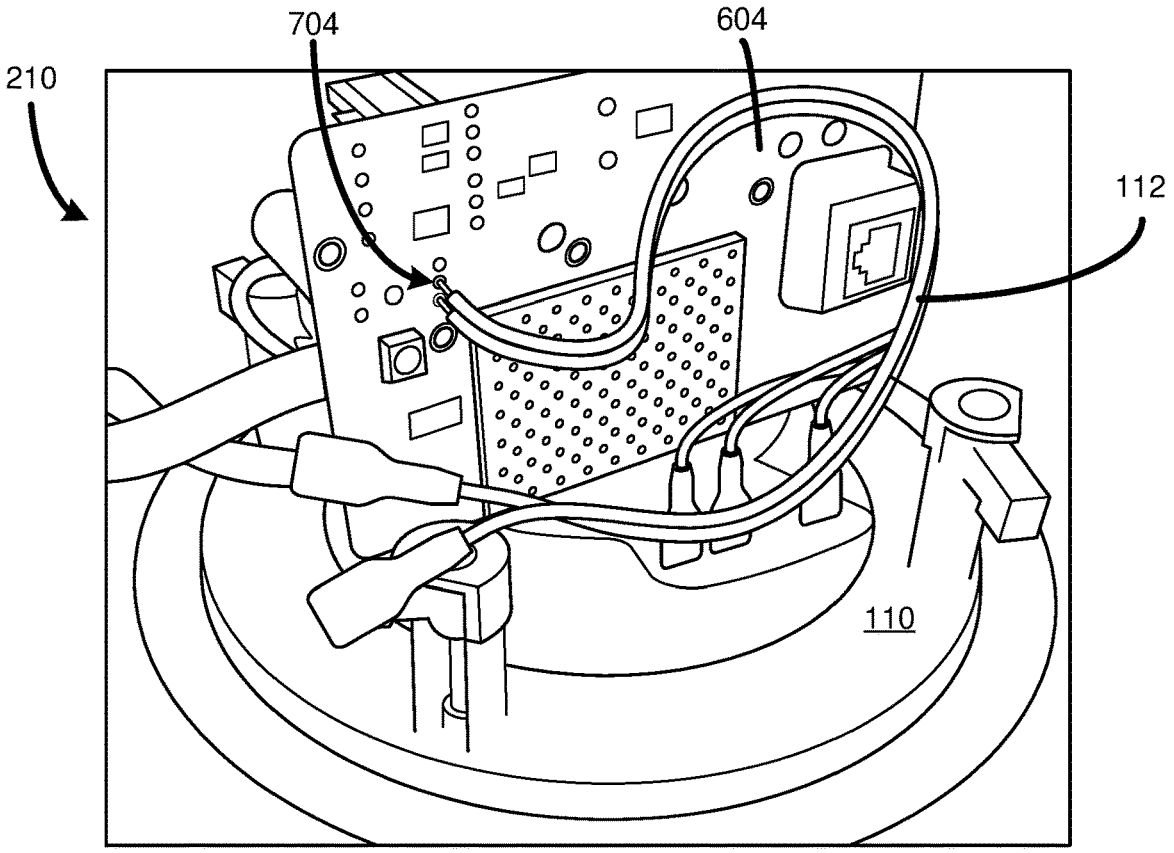
FIG. 8*a* is an oblique photograph of the power-input side an exemplary media-source-integrated speaker circuit board mounted on an exemplary in-wall speaker.
Figure 8B:
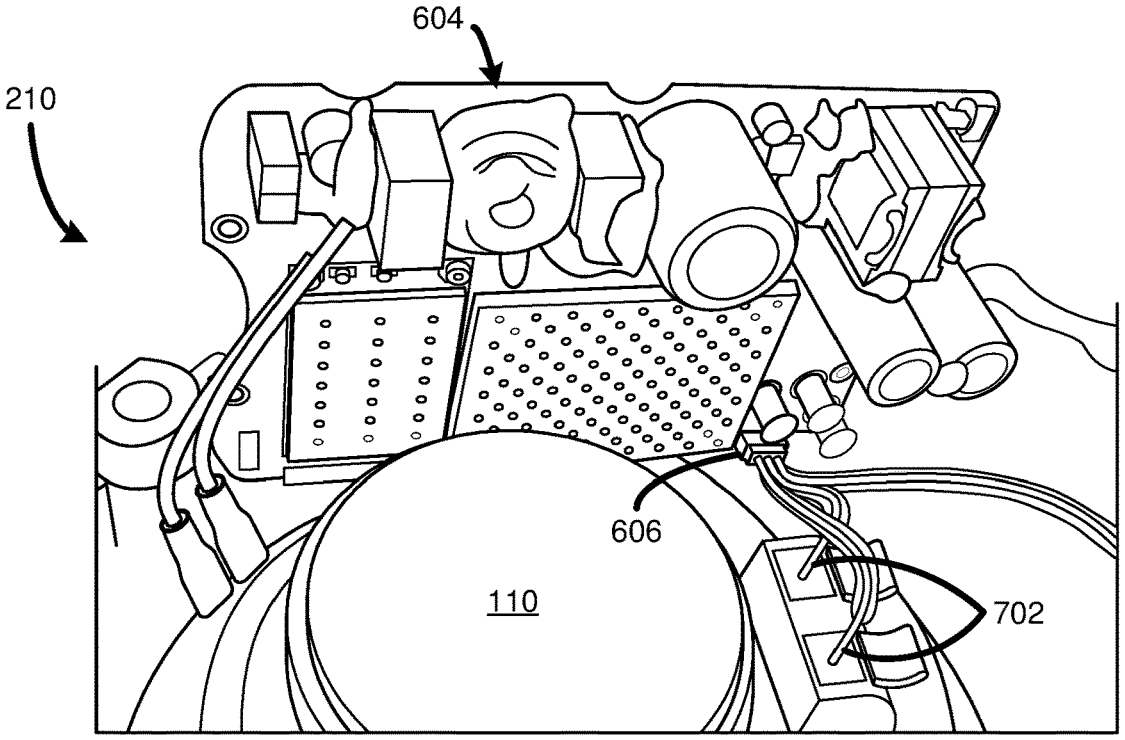
FIG. 8*b* is an oblique photograph of the speaker-output side an exemplary media-source-integrated speaker circuit board mounted on an exemplary in-wall speaker.

Referring now primarily to FIGS. 6, 7*a*, 7*b*, 8*a*, and 8*b*, an appropriate exemplary MSI speaker 210 may be created by combining an MSI speaker circuit board 604 and a conventional speaker 110. A suitable MSI speaker circuit board 604 may be obtained from a self-contained speaker system, such as the Sonos™ speaker shown in FIG. 6. After opening the Sonos™ speaker case, the circuit board 604 may be removed. The circuit board 604 may be disconnected from its native power source wiring (not shown). The circuit board 604 may be powered by low-voltage power supply 204. Referring to FIG. 7*b*, low-voltage power inputs 704 are designated. The low-voltage power inputs 704 may be identified during the disassembly. In the exemplary embodiment, the negative (black) power wire is shown soldered to the negative input terminal of the low-voltage power inputs 704. Other forms of connection may be suitable. The positive terminal is identified with a "+" symbol, but the positive (red) power wire is shown off to the side and not connected to the positive terminal of the low-voltage power input 704. The low-voltage power supply 204 will be connected to the exemplary circuit board 604 when both the positive and negative wires are appropriately connected to the low-voltage power input 704.

The circuit board 604 may also be disconnected from its native output wiring 702 at output connector 606. Alternatively, the native output wiring 702 may be used to connect to the speaker inputs 402 of a speaker 110. The circuit board 604 may be designed to create a media signal, which may be transmitted to the speaker 110 through connector 606 and output wiring 702.

This is one example of how to create an MSI speakers 210. Other types and designs of conventional speakers 110 may be used in combination with other types and designs of MSI speaker circuit boards 604 to create MSI speakers 210 suitable for a wide-variety of in-wall speaker enclosures that may support wide-range of locations and environments from which sound media may be desired.

Figure 9:
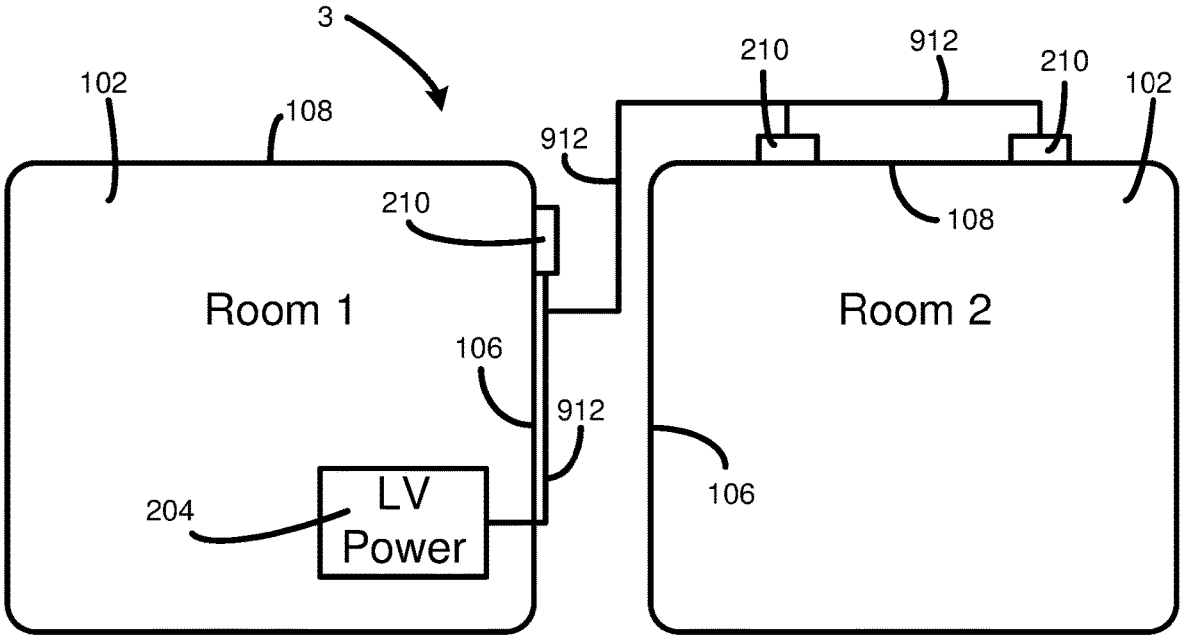
FIG. 9 is a schematic depiction of an alternate exemplary media-source-integrated speaker-based sound system supported by lightweight power wiring, according to the present disclosure.

Referring now primarily to FIG. 9, an alternate exemplary MSI speaker system 3 is shown. In the exemplary embodiment, suitable low-voltage wiring 912 is shown to connect to multiple MSI speakers 210 in series. The exemplary low-voltage wiring 912 extends through the spaces between the walls 106 and ceilings 108. A short connection may then be made from each of the MSI speakers 210. Since the current to run between the MSI speakers 210 and the low-voltage wiring 912 is low-voltage, no special connectors, or electrical boxes may be required.

Figure 10:
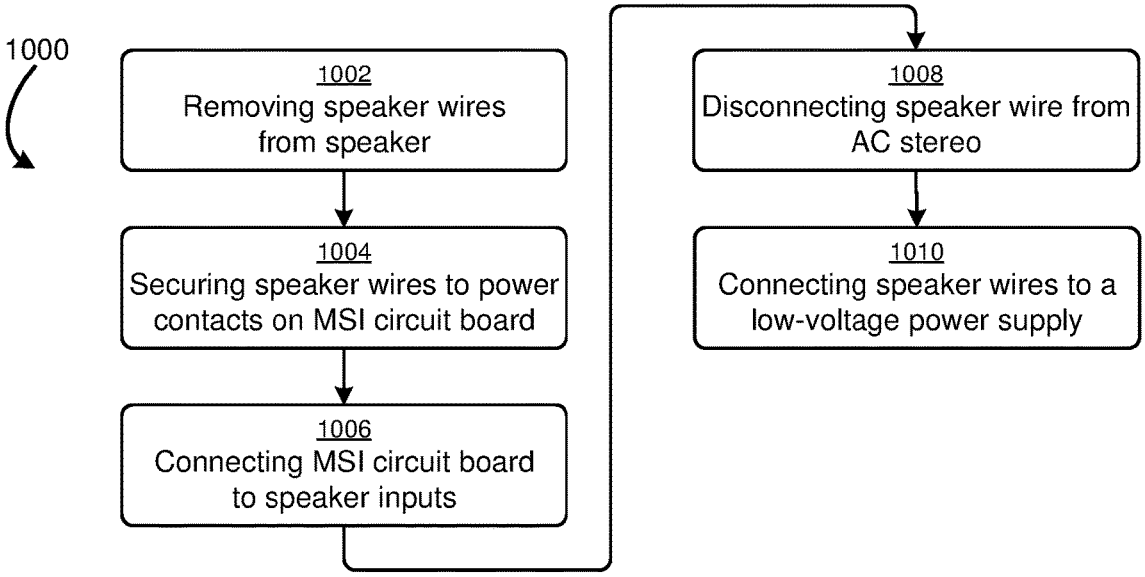
FIG. 10 is an exemplary process flow diagram for converting a conventional in-wall, wired stereo system to a media-source-integrated speaker-based sound system according to the current disclosure.

Referring now primarily to FIG. 10, an exemplary process for converting 1000 a conventional in-wall, wired stereo system 1, to an MSI speaker-based sound system 2 is offered. The process may include disconnecting 1002 speaker wires 112 from the standard speakers 110. Securing 1004 speaker wires 112 to low-voltage power input 704 on the MSI speaker circuit board 604. Connecting 1006 MSI speaker circuit board 604 to speaker inputs 402. Disconnecting 1008 speaker wire from an AC stereo. And connecting 1010 speaker wires 112 low-voltage power supply 204.

Figure 11:
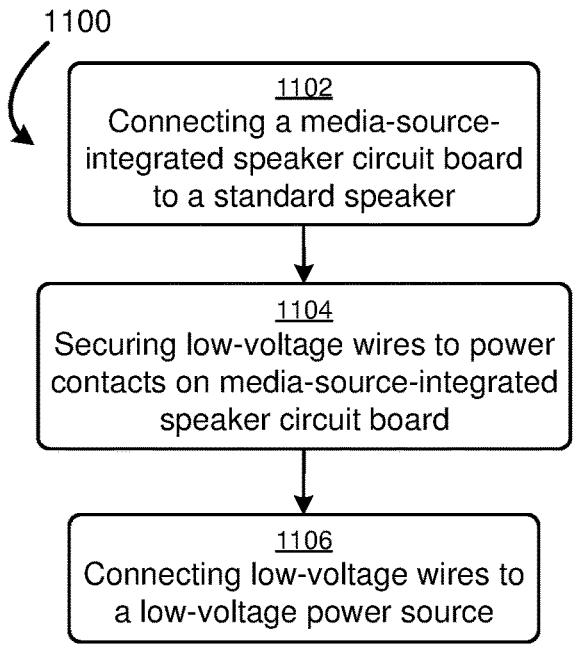
FIG. 11 is an exemplary process flow diagram for creating a custom media-source-integrated speaker and forming a media-source-integrated speaker-based sound system therefrom.

Referring now primarily to FIG. 11, an exemplary process for creating 1100 a custom MSI speaker 210 and forming and MSI speaker-based sound system (2, 3) therefrom is offered. The process may include connecting 1102 an MSI speaker circuit board 604 to a standard speaker 110. Securing 1104 a low-voltage power cord 504 to low-voltage power inputs 704 on and MSI speaker circuit board 604. Connecting 1106 low-voltage power cord 504 to a low-voltage power supply 204, such as an AC to DC transformer.

Figure 12:
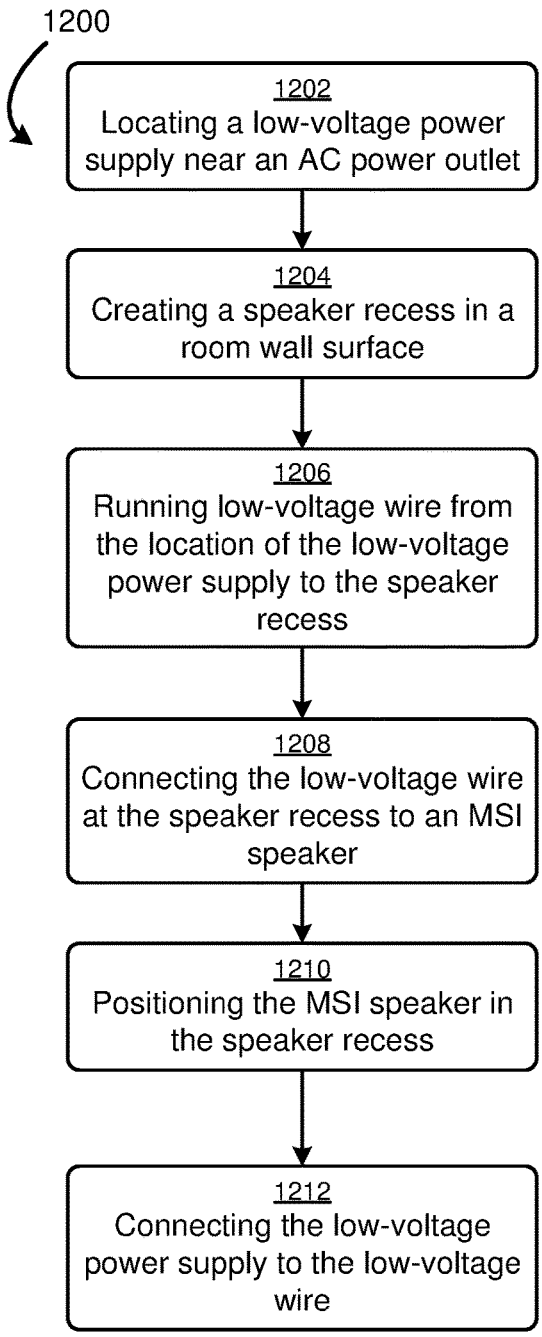
FIG. 12 is an exemplary process flow diagram for employing a media-source-integrated speaker-based sound system in renovation or new construction according to the current disclosure.

Referring now primarily to FIG. 12, an exemplary process for employing 1200 the present system in renovation or new construction includes locating 1202 a low-voltage power supply 204 near an AC power outlet 302. Creating 1204 a speaker recess 111 in a room wall surface (106, 108). Running 1206 a length of low-voltage wire 112 from the location of the low-voltage power supply 204 to the speaker recess 111. Connecting 1208 the low-voltage wire 112 at the speaker recess 111 to an MSI speaker 210. Positioning 1210 the MSI speaker 210 in the speaker recess 111. And connecting the low-voltage power supply 204 to the low-voltage wire 112.

The examples contained in this specification are merely possible implementations of the current system, and alternatives may still fall within the scope of the allowed claims. The foregoing disclosure and description of the invention is illustrative and explanatory thereof. The present invention should only be limited by the following claims and their legal equivalents, since the provided exemplary embodiments are only examples of how the invention may be employed, and are not exhaustive.

An example of a potential claim may include a media-source-integrated sound system, comprising at least one media-source-integrated speaker, a low-voltage power supply, and a length of low-voltage wire capable of operatively connecting the transformer to the at least one media-source-integrated speaker. This media-source-integrated sound system of claim may also include the at least one media-source-integrated speaker further comprising at least one audio speaker and an MSI speaker circuit board. This media-source-integrated sound system of claim may also include the at least one MSI speaker board further comprising an amplifier, a music source interface, and at least one of a control interface, wireless communications module, wired communication module, memory, and a computerized control processor.

I claim:

1. A process for converting a wired stereo system to a media-source-integrated speaker-based sound system in a structure having at least one room, the room having a wall and a ceiling, and the stereo system having an AC stereo connected to at least one standard speaker positioned in a wall surface recess by speaker wire, comprising:

disconnecting the speaker wire from the at least one standard speaker;

securing the speaker wire to a low-voltage power input on an MSI speaker circuit board;

connecting MSI speaker circuit board to speaker inputs;

disconnecting the speaker wire from an AC stereo; and connecting speaker wire to a low-voltage power supply.

2. The process of claim 1, wherein securing the speaker wire to a low-voltage power input on an MSI speaker further comprising:

securing the speaker wire to a low-voltage power input on an MSI speaker circuit board; and connecting MSI speaker circuit board to speaker inputs on the at least one standard speaker.

* * * * *